United States Patent [19]

Barichello

[11] 4,018,386

[45] Apr. 19, 1977

[54] RESILIENT SPRINKLER RISER

[75] Inventor: Gary Douglas Barichello, Pasco, Wash.

[73] Assignee: Michener Associates, Inc., Pasco, Wash.

[22] Filed: Mar. 8, 1976

[21] Appl. No.: 665,092

[52] U.S. Cl. ..... 239/200; 239/230; 239/588; 285/239

[51] Int. Cl.² ..... B05B 3/02

[58] Field of Search ..... 239/588, 201, 230, 229, 239/200; 285/239; 40/145 A; 52/113

[56] References Cited

UNITED STATES PATENTS

| | | | |
|---|---|---|---|
| 555,147 | 2/1896 | Burck | 239/588 |
| 1,727,962 | 9/1929 | Buskard | 239/588 X |
| 2,061,987 | 11/1936 | Sorensen | 239/588 UX |
| 3,478,967 | 11/1969 | Horton et al. | 239/588 |
| 3,587,972 | 6/1971 | Weeth | 239/212 |
| 3,759,445 | 9/1973 | King | 239/588 X |

*Primary Examiner*—John J. Love
*Attorney, Agent, or Firm*—Wells, St. John & Roberts

[57] ABSTRACT

A resilient sprinkler riser is described for mounting a pulsating type sprinkler head wherein a nozzle is utilized to direct a spray jet of water in a radial direction from a vertical axis of rotation while a pivoted deflector member operates to rotate the nozzle about the vertical axis. The riser includes a flexible tube that is coaxially mounted within an elongated closed helical tension spring. The spring is fastened at its lower end relative to the tube while its upper end is free to slide coaxially over the tube length. The spring is pretensioned to hold the pipe in an upright condition under the reaction forces exerted by a jet of water exiting through the sprinkler nozzle. However, the spring tension is not sufficient to hold the tube in an upright condition when excessive external lateral forces are applied. When this happens, the riser will deflect in the direction of the force. When the force is removed, the riser will spring back to a normal upright condition.

8 Claims, 3 Drawing Figures

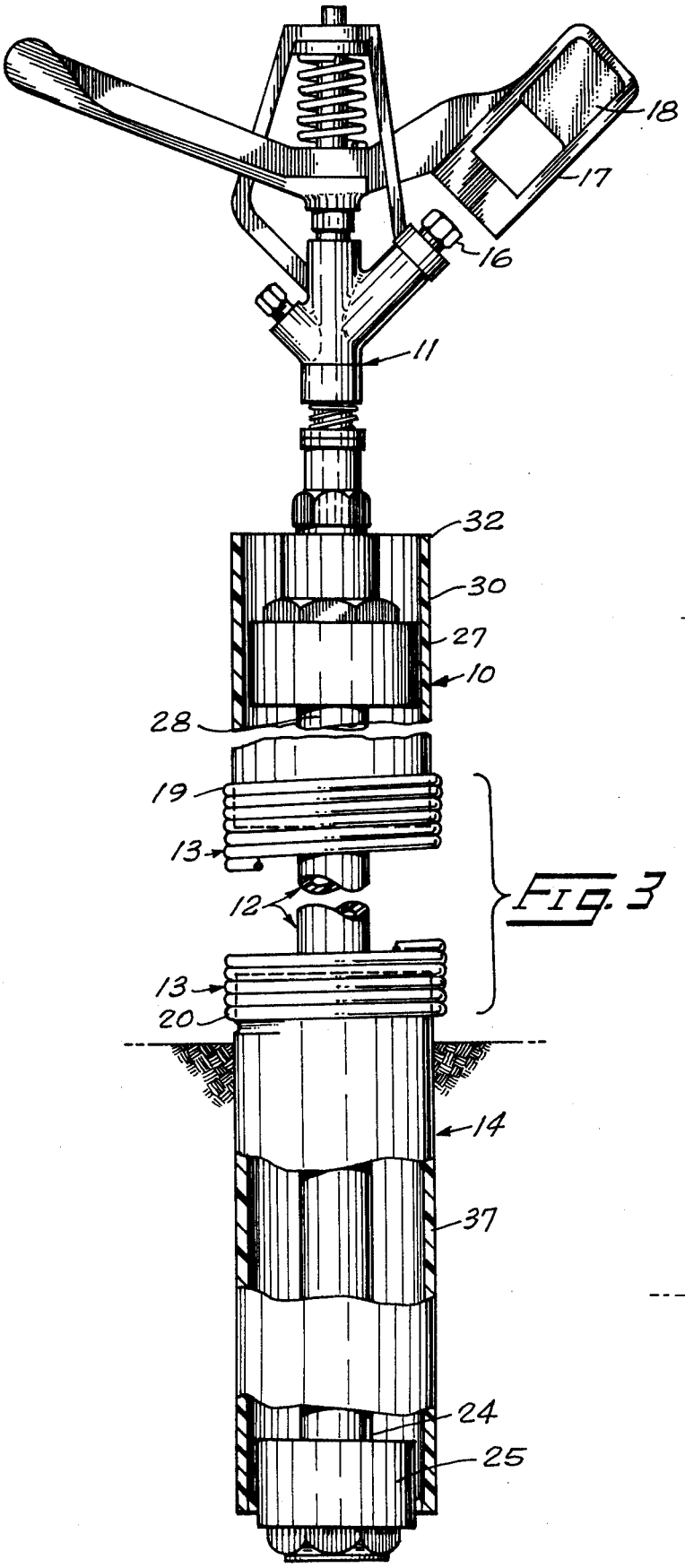
Fig. 3
Fig. 1
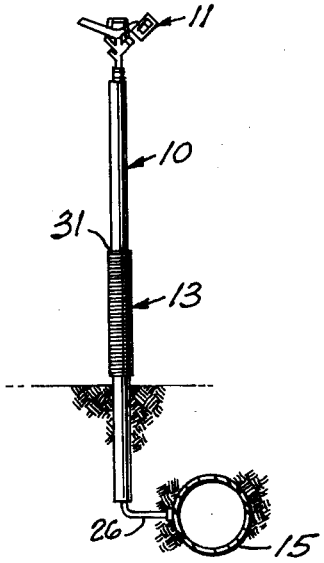
Fig. 2
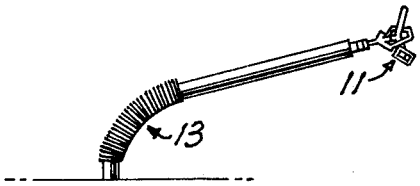

RESILIENT SPRINKLER RISER

BACKGROUND OF THE INVENTION

The present invention is related to risers for sprinkler heads and more particularly to such risers that provide the capability of allowing lateral deflection of a sprinkler head and for returning the head to an upright condition after such deflection.

It is a problem, particularly with fixed in place irrigation systems which utilize sprinkler risers, to prevent grazing animals from rubbing or bumping against the upright risers to bend them over or otherwise damage the sprinkler head. Such sprinkler risers are also prone to damage from vehicles being driven over the irrigated area. It has therefore become desirable to devise some form of resilient sprinkler riser that will bend in response to excessive lateral forces, but will spring back to hold the sprinkler head upright while the sprinkler is in operation.

U.S. Pat. No. 3,759,445 to Robert W. King discloses a flexible fitting for lawn sprinklers. This fitting is located below ground between a riser pipe and water supply pipe. The fitting is flexible. However, there is no designed resiliency that would tend to move the riser back to an upright condition after being deflected.

U.S. Pat. No. 555,147 to J. H. Burck discloses a flexible spraying pipe. This pipe is constructed of a flexible material such as rubber and includes an elongated expanded helical spring extending coaxial therewith along a portion of the pipe length. Both ends of the spring are fixed to the spray tube. A slidable collar is mounted to the tube below the spring and is connected by an elongated link to a radial arm protruding from the upper spring end. The lower end of the link is also connected to a radial arm of the slidable collar. The collar will slide axially along the tube in response to axial force. However, an eccentric force such as that applied through the link to the arm will tend to bind the collar in place on the tube, therefore holding the upward end in a desired configuration. The spring is therefore not resilient in the sense that it is incapable of automatically returning the water supply tube to an upright condition after the tube has been deflected laterally. The expanded or "open" helical spring alone would not hold the sprinkler head still under the normal operating forces applied by an operating pulsating sprinkler head. Instead, such a spring would deflect (even if only slightly) and upset the sprinkling pattern designed for the particular sprinkler head.

U.S. Pat. No. 2,061,987 to O. A. Sorensen discloses a spray device that, like the Burck device, utilizes an elongated flexible tube to position a spray head. The delivery tube is elongated and includes a coaxial flexible metal hose made up of interlinked annular channels. The metallic flexible hose allows selective positioning of the spray head and will hold the delivery tube in a selected angular position. No provision is made to automatically return the delivery tube to an upright position after such deflection.

U.S. Pat. No. 3,587,972 to Waldo W. Weeth discloses an irrigation system made up of a plurality of rotating flexible pipe sprinklers. These pipes do not include outside support and rely upon water pressure to maintain the flexible portion of the delivery tube in an upright condition. No provision is made, other than water pressure applied through the tube, to hold the water delivery tube in an upright condition.

It is a first object of the invention to provide a resilient sprinkler riser that is designed to deflect in response to an animal or vehicle coming into contact with the sprinkler head or riser body; and that, after such deflection, will return the sprinkler head and delivery tube to an upright condition.

It is another important object to provide such a resilient sprinkler riser that will withstand normal lateral operating forces produced by a pulsating, rotational type sprinkler head.

It is a still further object to provide such a resilient sprinkler riser that is very simple in construction and easy to install.

These and still further objects and advantages will become apparent upon reading the following description which, taken with the accompanying drawings, disclose a preferred form of the present invention.

BRIEF DESCRIPTION OF THE DRAWINGS

A preferred form of the present invention is illustrated in the accompanying drawings in which;

FIG. 1 is a plan view of the present resilient riser;

FIG. 2 is a view similar to FIG. 1 only showing the riser in a deflected condition; and FIG. 3 is an enlarged fragmentary view of the present resilient riser structure.

DETAILED DESCRIPTION OF A PREFERRED EMBODIMENT

A preferred form of the present resilient sprinkler riser is illustrated in the accompanying drawings and is generally designated therein by the reference character 10. Basically, the present riser is utilized to elevate a sprinkler head 11 at an upper end of an upright flexible water supply tube 12. A closed coil tension spring 13 loosely and coaxially encircles the supply tube from its upper end to a lower end where the spring is held stationary relative to tube 12 by a mounting means 14. Water is delivered to the riser 10 through a water supply pipe 15 (FIG. 1) that is situated below ground level. However, it is not intended that this application be restricted by such particular usage since the present riser structure will function equally as well with a water delivery pipe located above ground.

FIG. 3 illustrates the sprinkler head 11 in substantial detail. Specifically, the sprinkler head 11 includes a nozzle 16 for directing water at a prescribed angle and in a radial direction from a vertical rotational axis. A spring deflector 17 is pivotably mounted to the sprinkler head body and oscillates in response to spring action that forces impingement of a deflector plate 18 against the stream of water emitting from nozzle 16. Plate 18 translates some of the force produced by the water spray to torsion for moving the sprinkler head about its vertical rotational axis.

The closed helical spring 13 includes an open upper end 19 that is located downward from an upper end of supply tube 12. Spring 13 also includes a lower end 20 that is located above a lower end of the supply tube 12. The spring end 20 is mounted to the supply tube 12 by mounting means 14.

Water supply tube 12 is located coaxially within the closed coils of spring 13. It extends from a lower end 24 upwardly to sprinkler head 11. A fitting 25 of conventional form mounts the lower end of the tube 12 to a branch delivery tube 26 (FIG. 1) of water pipe 15. Similarly, a fitting 27 is provided at an upper end 28 of tube 12 that receives the upper end of the tube and threadably receives a complementary mounting portion of the sprinkler head 11.

The fitting 27 is slidably received within a sleeve 30. Sleeve 30 is mounted to the upper end 19 of spring 13. The sleeve includes an end portion 31 fastened in an appropriate manner to the spring end. Sleeve 30 extends upwardly from upper spring end 19 to an end 32 that loosely encircles the fitting 27. It is important that a slidable fit is maintained between sleeve 30 and fitting 27 to enable both spring 13 and supply tube 12 to deflect laterally. The result is that deflection of the two members in unison will result in sliding movement of sleeve 30 or spring end 19 in relation to the supply tube 12. If this sliding motion were not allowed, the spring 13 would rigidly hold tube 12 in an upright condition and not function properly to provide the desired resilient characteristics.

Mounting means 14 is comprised of an anchor collar 37 that is similar to the sleeve 30. Collar 37 is positioned at the lower ends of the supply tube and spring 13 and is fastened by appropriate means to the lower spring end at the upper collar end thereof. It is intended that a portion of collar 37 extend above a ground level as is shown in FIGS. 1 and 3. The remaining portion extends below the ground level and is operatively connected to the supply tube 12 through fitting 25. The collar 37 may be fixed directly to fitting 25, or it may be slidably mounted over the supply tube 12 to be secured upon installation of the sprinkler riser. In this case, the surrounding earth would secure the collar against movement relative to the tube 12.

It is preferred that the tube 12 itself be formed of a flexible synthetic resin material. Preferably the tube is constructed of extruded polyvinyl chloride (PVC). This material is very flexible and is well adapted for water handling purposes. The fittings 25 and 27 are easily affixed to the opposed tube ends by an appropriate adhesive conventionally utilized for such purposes.

In normal operation, water is delivered through supply tube 12 from pipe 15 to exit through the nozzle 16. The resulting jet of water produces a reaction force that continuously changes direction as the sprinkler head rotates about its axis. The reaction force is produced in a direction opposite to the flow of water through the nozzle. It can be calculated using known formulas that, given a nozzle diameter of 0.14063 inches and a constant water pressure of 60 psi with an angle of nozzle discharge from a horizontal plane of 23°, the horizontal reaction force is equal to 2.58 lbs. In order to prevent this force from producing a bend along the length of the riser, the spring must be selected to have sufficient longitudinal rigidity such that this force will not overcome the tendency for the spring to retain its upright vertical position.

It has been found that a closed helical coil spring that has been pre-tensioned with a prescribed initial tension load is best adapted for this purpose. For the example stated above, a closed helical tension load (pretension) of 70.76 lbs., with a mean spring diameter of 2.1875 inches and wire diameter of 0.3125 inches and a length (along the axis of the water supply tube) of 12 inches, will hold the tube upright without any deflection whatsoever in opposition to the reaction force (2.58 lbs.) produced by the stream of water emitting from nozzle 16. However, lateral forces applied to the riser in excess of the normal reaction force applied by the sprinkler head, will cause deflection of the spring along its length and corresponding deflection of the supply tube 12 therein. The inherent spring tension will automatically return the riser to the normal upright condition when the excessive force is removed.

Riser deflection due to excessive lateral forces may be caused by grazing animals rubbing against the riser or sprinkler head or by inadvertent contact by vehicles or farm implements. The riser will deflect in relatively any direction an amount of 90° (or more) to the vertical axis and subsequently return the sprinkler head and supply tube to a vertical position.

Since a coil spring has the properties of being substantially stable about its circumference, spring 13 will effectively resist the reaction force produced by the water jet from any radial angle relative to the vertical riser axis. The joined coils of the spring permit no deflection until a lateral force in excess of a normal operating force is applied against the riser. At this time the riser will deflect in the direction of the force to prevent damage to the sprinkler head and possible damage to the animal or whatever object is producing such force.

It is understood that various changes may be made with regard to the above description of a preferred embodiment. For example, springs of different lengths, different mean diameters and differing over-all strength characteristics may be readily utilized with the present structure. It is also noted that the riser may be used in any above ground delivery pipe situation. Therefore, it is intended that only the following claims be taken as definitions and restrictions upon the scope of this invention.

What I claim is:

1. A resilient sprinkler riser comprising:

an elongated flexible water supply tube having a desired exterior diameter adapted to be connected to a water supply pipe at a lower end and extending upward therefrom to an upper end for receiving a sprinkler head;

an elongated resilient closed coil spring having an interior diameter greater than the exterior diameter of the water supply tube and extending between a lower end and an upper end and adapted for mounting coaxially about the water supply tube;

mounting means for mounting the closed coil spring coaxially about the water supply tube with the lower end of the closed coil spring being held in relation to the water supply tube and with the upper end of the closed coil spring being free to move axially with respect to the water supply tube when the upper end of the water supply tube is laterally deflected with respect to the lower end of the water supply tube; and said closed coil spring being sufficiently pretensioned along its length to: (a) hold the flexible supply tube in an upright condition against normal radial reaction forces applied to the tube by an operating sprinkler head, (b) allow lateral resilient deflection of the tube along its length in response to forces exceeding the normal reaction forces, and (c) return the tube to an upright condition after such deflection.

2. The resilient sprinkler riser as defined by claim 1 further comprising:

a sleeve mounted to the upper spring end and encircling the tube for sliding engagement therewith.

3. The resilient sprinkler riser as defined by claim 1 wherein the mounting means is comprised of an anchor collar mounted to the lower end of the spring and encircling the water supply tube, and wherein the anchor collar is operatively fixed to the water supply tube.

4. The resilient sprinkler riser as set out in claim 3 further comprising:

a sleeve mounted to the upper spring end and encircling the tube for sliding engagement therewith.

5. In combination with a pulsating sprinkler head of the type driven by water pressure to rotate about a vertical axis while emitting a pulsating jet of water in a radial direction therefrom; a resilient riser, comprising:

an elongated flexible water supply tube having a desired exterior diameter adapted to be connected to a water supply pipe at a lower end and extending therefrom to an upper end supporting the sprinkler head;

an elongated resilient closed coil spring having an interior diameter greater than the exterior diameter of the water supply tube and extending between a lower end and an upper end and adapted for mounting coaxially about the water supply tube;

mounting means for mounting the closed coil spring coaxially about the water supply tube with the lower end of the closed coil spring being held fixed in relation to the water supply tube and with the upper end of the closed coil spring being free to move axially with respect to the water supply tube when the upper end of the water supply tube is laterally deflected by the pulsating jet of water; and said closed coil spring being sufficiently pretensioned along its length to: (a) hold the flexible supply tube in an upright condition against the radial reaction forces of the pulsating jet of water, (b) allow lateral resilient deflection of the tube along its length in response to forces against the flexible supply tube exceeding the normal reaction forces of the pulsating jet of water, and (c) return the tube to the upright condition when the exterior exceeding forces are removed.

6. The combination set out by claim 5 further comprising:

a sleeve mounted to the upper spring end and encircling the tube for sliding engagement therewith.

7. The combination set out by claim 5 wherein the mounting means is comprised of an anchor collar mounted to the lower end of the spring and encircling the water supply tube, and wherein the anchor collar is operatively fixed to the water supply tube.

8. The combination set out by claim 7 further comprising:

a sleeve mounted to the upper spring end and encircling the tube for sliding engagement therewith.

* * * * *